US009689605B2

(12) United States Patent
Jung

(10) Patent No.: US 9,689,605 B2
(45) Date of Patent: Jun. 27, 2017

(54) REFRIGERATOR

(71) Applicant: LG ELECTRONICS INC., Seoul (KR)

(72) Inventor: Sungki Jung, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 14/945,689

(22) Filed: Nov. 19, 2015

(65) Prior Publication Data

US 2016/0146533 A1 May 26, 2016

(30) Foreign Application Priority Data

Nov. 20, 2014 (KR) ..... 10-2014-0162594

(51) Int. Cl.

| | |
|---|---|
| ***A47B 96/04*** | (2006.01) |
| ***F25D 25/02*** | (2006.01) |
| ***A47B 88/40*** | (2017.01) |
| ***A47B 88/463*** | (2017.01) |
| *F25D 23/02* | (2006.01) |
| *F25D 23/06* | (2006.01) |

(52) U.S. Cl.

CPC ..... *F25D 25/025* (2013.01); *A47B 88/40* (2017.01); *A47B 88/463* (2017.01); *F25D 23/021* (2013.01); *F25D 23/028* (2013.01); *F25D 23/02* (2013.01); *F25D 23/067* (2013.01); *F25D 2201/30* (2013.01)

(58) Field of Classification Search

CPC .... A47B 2210/0027; A47B 2210/0078; A47B 2210/175

USPC ..... 312/331, 401, 402, 404

See application file for complete search history.

(56) References Cited

U.S. PATENT DOCUMENTS

| | | | | |
|---|---|---|---|---|
| 8,141,968 | B2 * | 3/2012 | Velarde | A47B 88/493 312/331 |
| 8,894,166 | B2 * | 11/2014 | Laible | F25D 25/025 312/319.1 |
| 2004/0035129 | A1 * | 2/2004 | Kaiser | A47B 88/40 62/302 |
| 2009/0045713 | A1 * | 2/2009 | Kunkle | A47B 88/40 312/402 |
| 2012/0091872 | A1 | 4/2012 | Matthes et al. | |

FOREIGN PATENT DOCUMENTS

| | | |
|---|---|---|
| EP | 2674708 | 12/2013 |
| KR | 20-0338105 | 1/2004 |
| KR | 10-2014-0037474 | 3/2014 |

* cited by examiner

*Primary Examiner* — Matthew Ing
(74) *Attorney, Agent, or Firm* — Fish & Richardson P.C.

(57) ABSTRACT

A refrigerator is described. The refrigerator includes a body. The refrigerator further includes a door. The refrigerator further includes a first rail guide and a second rail guide. The refrigerator further includes a first rail assembly and a second rail assembly. The refrigerator further includes a shaft that is configured to connect the first rail assembly with the second rail assembly. The refrigerator further includes a first pinion that is located at a first end of the shaft and configured to engage the first rail guide based on the door being pushed in or pulled out. The refrigerator further includes a second pinion that is located at a second end of the shaft and configured to engage the second rail guide based on the door being pushed in or pulled out. The refrigerator further includes a torsion reduction part that is configured to reduce torsion of the door.

17 Claims, 14 Drawing Sheets

REFRIGERATOR

CROSS-REFERENCE TO RELATED APPLICATION

This application claims priority under 35 U.S.C. §119 to Korean Patent Application No. 10-2014-0162594, filed in Korea on Nov. 20, 2014, whose entire disclosure is hereby incorporated by reference.

FIELD

A refrigerator is disclosed herein.

BACKGROUND

Generally, a refrigerator may be classified into a general type refrigerator, a side-by-side type refrigerator and a bottom freezer type refrigerator according to structures of a freezer compartment and a refrigerator compartment.

In the general type refrigerator, the freezer compartment is located at an upper side thereof, and the refrigerator compartment is located at a lower side thereof, and in the side-by-side type refrigerator, the freezer compartment and the refrigerator compartment are disposed side by side.

The bottom freezer type refrigerator is recently used widely in the US or Europe, and has a structure in which the refrigerator compartment formed larger than the freezer compartment is located at an upper side thereof, and the freezer compartment is located at a lower side thereof. A plurality of doors are installed at the freezer compartment, and a drawer is installed inside each door.

SUMMARY

An innovative aspect of the subject matter described in this specification may be implemented in a refrigerator that includes a body that defines a storage space; a door that is configured to selectively open and close the storage space; a first rail guide that is connected to a first side wall of the storage space; a second rail guide that is connected to a second side wall of the storage space; a first rail assembly that is configured to connect the door with the first rail guide; a second rail assembly that is configured to connect the door with the second rail guide; a shaft that is configured to connect the first rail assembly with the second rail assembly; a first pinion that is located at a first end of the shaft and that is configured to engage the first rail guide based on the door being pushed in or pulled out; a second pinion that is located at a second end of the shaft and that is configured to engage the second rail guide based on the door being pushed in or pulled out; and a torsion reduction part that is located at one of the first rail guide or the second rail guide, that is configured to reduce torsion of the door, and that includes an idle gear (i) that includes a hinge shaft that is rotatably inserted into the one of the first rail guide or the second rail guide and (ii) that is configured to selectively engage one of the first pinion or the second pinion; and an elastic support part that is connected to a lower end of the idle gear and that is connected to the one of the first rail guide or the second rail guide, where the hinge shaft is configured to move forward and backward based on being inserted into a guide part that is located at the one of the first rail guide or the second rail guide.

These and other implementations can each optionally include one or more of the following features. The guide part is a hole or a groove that extends forward and backward a predetermined length. The refrigerator further includes a repulsive force generation part that is located at the idle gear and the one of the first rail guide or the second rail guide and that is configured to generate a force that pushes the idle gear forward. The repulsive force generation part includes a first magnet that is installed at the idle gear; and a second magnet that is installed at the one of the first rail guide or the second rail guide and that is configured to repel the first magnet. The elastic support part is a spring that is oriented vertically, that is coupled to a first coupling part of the idle gear, and that is coupled to a second coupling part of the one of the first rail guide or the second rail guide, the elastic support part being curved based on the first coupling part being moved to a rear of the second coupling part.

The elastic support part is configured to compress and a front end of the idle gear is configured to rotate downward based on one of the first pinion or the second pinion rotating in a first direction. The elastic support part is configured to support the front end of the idle gear and the idle gear is configured to move backward based on the one of the first pinion or the second pinion rotating in a second direction. The first direction is opposite the second direction. Based on the idle gear moving backward, a force that is applied to the idle gear by the repulsive force generation part is gradually increased. A guide protrusion is located at the idle gear, the guide protrusion being configured to guide rotation of the idle gear. The repulsive force generation part comprises an elastic member that connects the idle gear with the one of the first rail guide or the second rail guide. The idle gear includes a gear part that includes idle gear teeth that are spaced apart by a first distance.

The first rail guide and the second rail guide include rail guide teeth that are spaced apart by the first distance. An idle gear tooth and a rail guide tooth of the one of the first rail guide or the second rail guide are spaced apart by a second distance that is greater than the first distance. The gear part includes two idle gear teeth. A rack is connected to a lower side of the first rail guide and is connected to a lower side of the second rail guide. The first pinion is configured to move the rack based on the door being pushed in or pulled out. The second pinion is configured to move the rack based on the door being pushed in or pulled out. The refrigerator further includes a noise reduction part that connects one of the first rail guide or the second rail guide to an end of the idle gear that is opposite the lower end that is connected to the elastic support part. The noise reduction part is a spring.

DETAILED DESCRIPTION

Figure 1:
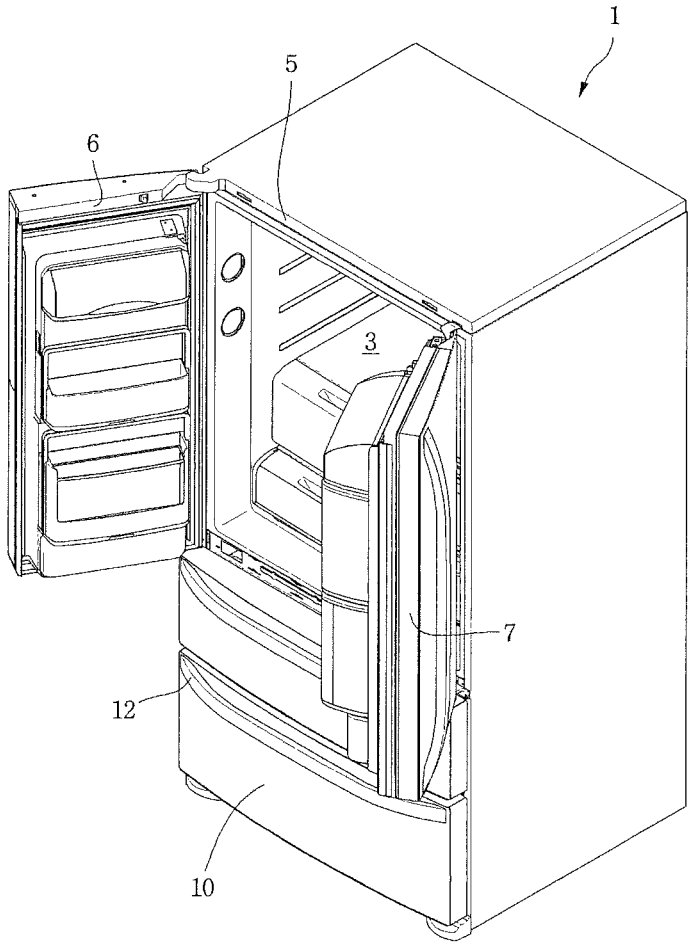
FIG. 1 is a perspective view of an example refrigerator.
Figure 2:
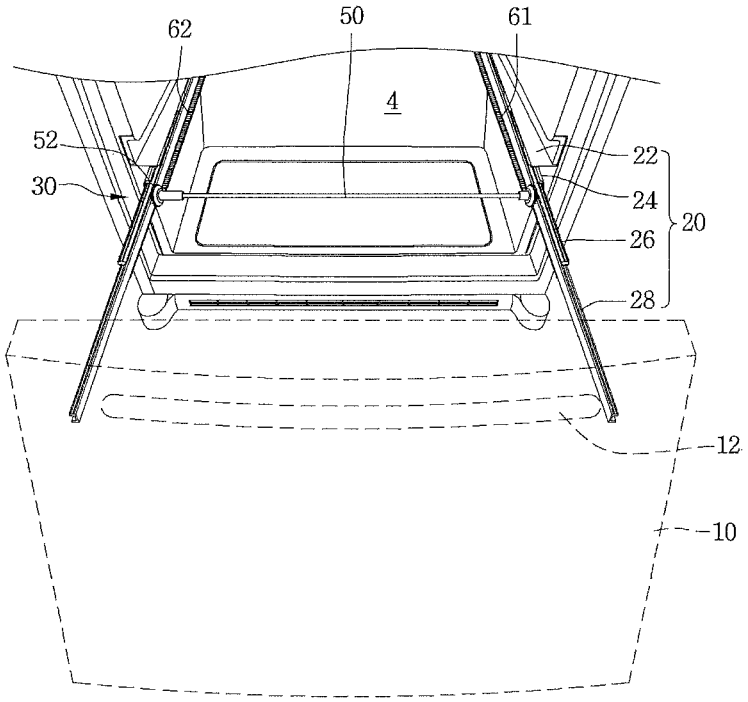
FIG. 2 is a view of an example door being drawn out.
Figure 3:
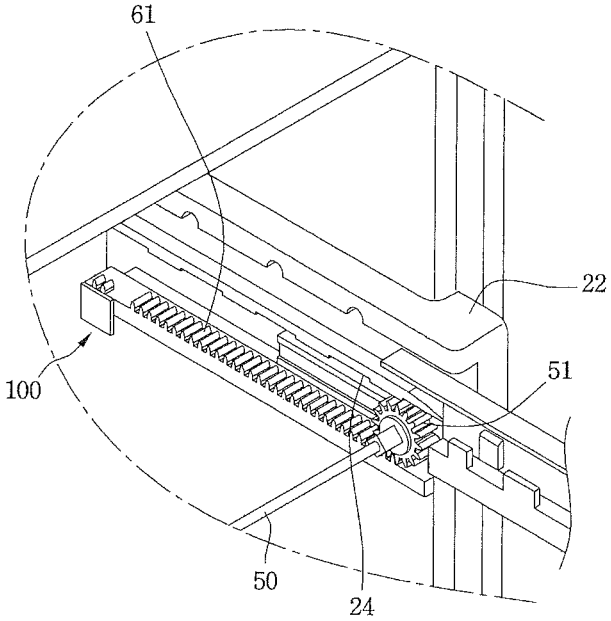
FIG. 3 is a view of an example rail assembly.

FIG. 1 illustrates an example refrigerator. FIG. 2 illustrates an example door being drawn out. FIG. 3 illustrates an example rail assembly.

Referring to FIGS. 1 to 3, the refrigerator 1 includes a refrigerator body 5 having storage compartments 3 and 4 formed therein, and a door which is provided at the refrigerator body 5 to open and close the storage compartments 3 and 4. The storage compartments 3 and 4 may be divided into an upper storage compartment 3 and a lower storage compartment 4.

The refrigerator 1 may be a bottom freezer type in which the upper storage compartment 3 corresponds to a refrigerator compartment for storing food, and the lower storage compartment 4 corresponds to a freezer compartment.

The door may include one pair of rotational doors 6 and 7 which open and close the upper storage compartment 3, and a sliding door 10 which is slid forward and backward with respect to the refrigerator body 5 and opens and closes the lower storage compartment 4. In the specification, a front or forward direction is a direction which is directed from the lower storage compartment 4 toward the door 10, and a rear or backward direction is a direction which is directed from the door 10 toward the lower storage compartment 4.

The pair of rotational doors 6 and 7 may be rotatably installed at left and right sides of a front surface of the refrigerator body 5, respectively. The sliding door 10 may be movably installed at an internal wall surface of the lower storage compartment 4. Hereinafter, the sliding door 10 is referred to as a door 10, and the lower storage compartment 4 is referred to as a storage chamber 4.

A handle 12 which horizontally extends long may be provided at a front surface of the door 10. The handle 12 may be coupled to a left side and a right side of the door 10. A user may grip a part of the handle 12 and may draw and insert the door 10.

The refrigerator 1 further includes one pair of rail assemblies 20 and 30 which are installed at the door 10 and enables the door 10 to be slid. The pair of rail assemblies 20 and 30 may be installed at both side wall surfaces of the storage compartment 4.

The pair of rail assemblies 20 and 30 may include a first rail assembly 20 which is installed at a right wall surface of the storage compartment 4, and a second rail assembly 30 which is installed at a left wall surface of the storage compartment 4. The first rail assembly 20 and the second rail assembly 30 may be provided in similar types so that left and right sides of the door 10 are equally supported. First, a structure of the first rail assembly 20 will be described.

The first rail assembly 20 may include a first support part 22 which is installed at the wall surface of the storage compartment 4, a first guide rail 24 which is installed at an inside of the first support part 22, a first middle rail 26 which is installed at an inside of the first guide rail 24, and a first movable rail 28 of which one end is inserted into an inside of the first middle rail 26 and the other end is installed at the door 10.

The second rail assembly 30 may include a second support part 32 which is installed at the wall surface of the storage compartment 4, a second guide rail 34 which is installed at an inside of the second support part 32, a second middle rail 36 which is installed at an inside of the second guide rail 34, and a second movable rail 38 of which one end is inserted into an inside of the second middle rail 36 and the other end is installed at the door 10.

While the guide rails 24 and 34, the middle rails 26 and 36 and the movable rails 28 and 38 are relatively moved, the door 10 may open and close the storage compartment 4.

Specifically, when the door 10 is inserted, the guide rails 24 and 34, the middle rails 26 and 36 and the movable rails 28 and 38 are overlapped with each other, and thus the storage compartment 4 may be closed. When the door 10 is drawn out, the guide rails 24 and 34, the middle rails 26 and 36 and the movable rails 28 and 38 are stretched out, and the storage compartment 4 may be opened.

The pair of rail assemblies 20 and 30 further includes one pair of pinions 51 and 52. The pair of pinions 51 and 52 includes a first pinion 51 which is installed at the first rail assembly 20, and a second pinion 52 which is installed at the second rail assembly 30. The first pinion 51 and the second pinion 52 may be installed at the movable rails 28 and 38, respectively.

The pair of pinions 51 and 52 are coupled to each other by one shaft 50. Therefore, the pair of rail assemblies 20 and 30 may be connected with each other by the shaft 50. Specifically, the shaft 50 may be installed at the movable rails 28 and 38.

The pair of pinions 51 and 52 may be coupled so as not to be rotated about the shaft 50. Therefore, when one of the pair of pinions 51 and 52 is rotated, the other one is also rotated equally. Due to such a structure, even when a user applies a force to one side of the door 10 instead of a center thereof, the door 10 is guided so that the other side of the door 10 may also be inserted or drawn out equally.

When one of the pair of pinions 51 and 52 is rotated, and one side of the door 10 at which the one pinion is located is drawn out, the other one of the pair of pinions 51 and 52 may also be rotated equally, and thus the other side of the door 10 may be drawn out.

In the same manner, when one of the pair of pinions 51 and 52 is rotated, and one side of the door 10 at which the one pinion is located is inserted, the other one of the pair of pinions 51 and 52 may also be rotated equally, and thus the other side of the door 10 may be inserted.

Further, the refrigerator 1 includes one pair of rail guides 61 and 62 having racks which are respectively coupled with the pair of pinions 51 and 52 to guide movement of each pinion. At this time, the pair of rail guides 61 and 62 include a first rail guide 61 which is engaged with the first pinion 51 and a second rail guide 62 which is engaged with the second pinion 52.

The first rail guide 61 may be installed at a lower side of the first rail assembly 20. The first rail guide 61 serves to guide the movement of the first pinion 51, and the rack which is formed from a front end of the rail assembly 20 to a rear end thereof may be provided at the first rail guide 61. This structure is equally provided at the second rail guide 62 and the second pinion 52.

Teeth corresponding to teeth formed at the first pinion 51 are formed on an upper surface of the first rail guide 61, and thus the first pinion 51 may be engaged therewith to be movable.

A torsion prevention part 100 which prevents torsion of the door 10 is provided at a rear end of the first rail guide 61. The torsion prevention part 100 will be described in detail with reference to FIG. 4 or the like.

Figure 4:
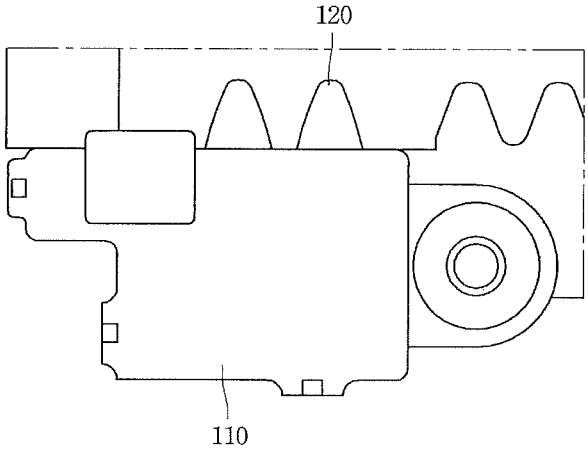
FIG. 4 is a view of an external appearance of an example torsion prevention part.
Figure 5:
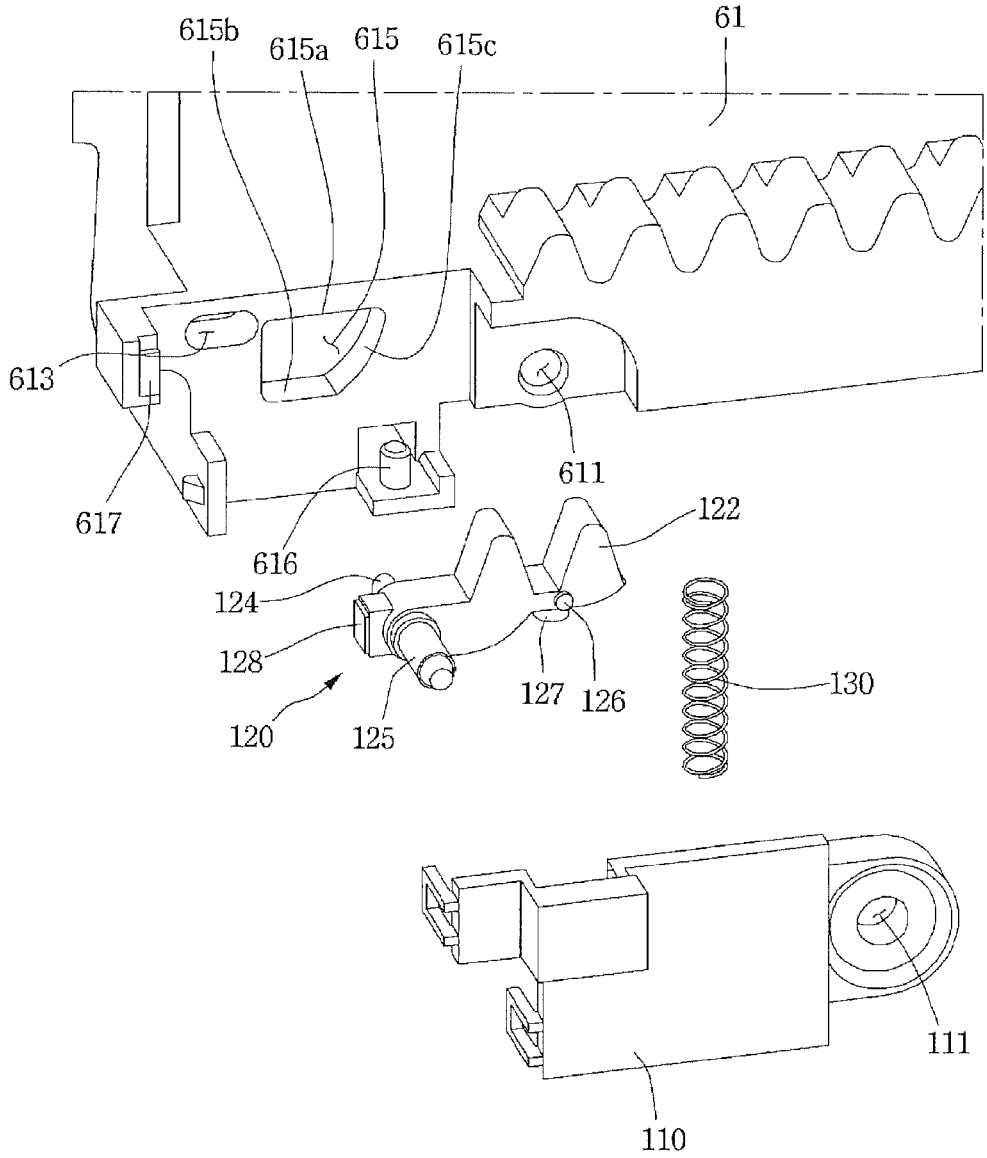
FIG. 5 is an exploded perspective view of an example torsion prevention part.

FIG. 4 illustrates an example torsion prevention part. FIG. 5 also illustrates an example torsion prevention part.

Referring to FIGS. 4 and 5, the torsion prevention part 100 may include a cover 110 which is installed at an rear end of the rack of the first rail guide 61, an idle gear 120 which is accommodated inside the cover 110 to be engaged with the first pinion 51, and an stretchable elastic support part 130 which connects a front end of the idle gear 120 with the first rail guide 61. The specification is described based on a fact that the torsion prevention part 100 is installed at the first rail guide 61. However, the torsion prevention part 100 may be installed at a rear end of the rack of the second rail guide 62.

A fastening hole 111 through which a fastening member for fastening the cover 110 to the first rail guide 61 passes may be provided at the cover 110. Also, a fastening hole 611 which is formed at a position corresponding to the fastening hole 111 and through which the fastening member passes may be provided at the first rail guide 61.

The idle gear 120 may include a gear part 122 which is formed to protrude from an upper end of a front end of the idle gear 120. In some implementations, the gear part 122 may be configured with two teeth. The number of the teeth may be appropriately changed according to a design.

The idle gear 120 may further include a first hinge shaft 124 which is formed to protrude from an inner side surface of the idle gear 120 and inserted into the first rail guide 61. Specifically, the first hinge shaft 124 may be inserted into a guide part 613 which is formed at the first rail guide 61. The idle gear 120 may be vertically rotated about the first hinge shaft 124.

The guide part 613 is formed at the first rail guide 61, and may be formed in a long hole or groove shape which extends forward and backward to a predetermined length. The first hinge shaft 124 may be movable forward and backward in the guide part 613. The gear part 122 may be moved forward and backward by movement of the first hinge shaft 124, and thus the gear part 122 may be easily engaged with the teeth of the first pinion 51. If a position of the first hinge shaft 124 is fixed, the first pinion 51 may not be properly engaged with the gear part 122 due to a dimensional error which may occur when the refrigerator is manufactured.

The idle gear 120 may further include a second hinge shaft 125 which is formed to protrude from an outer side surface of the idle gear 120 and inserted into the cover 110. The second hinge shaft 125 may be inserted into another guide part which is formed at the cover 110. Like the guide part 613, the other guide part which is formed at the cover 110 may be formed in the long hole or groove shape.

The idle gear 120 may further include a guide protrusion 126 which is inserted into the first rail guide 61 to restrict a vertical rotational range of the idle gear 120. A guide groove 615 in which the guide protrusion 126 is inserted may be formed at the first rail guide 61.

The guide groove 615 may include an upper surface 615*a* which restricts an upward rotational range of the guide protrusion 126, and a lower surface 615*b* which restricts a downward rotational range of the guide protrusion 126. Also, a side surface 615*c* of the guide groove 615 may be formed in a curved shape to guide rotation of the idle gear 120.

The idle gear 120 may further include a first coupling part 127 which is formed at a lower end of the gear part 122 and to which the elastic support part 130 is coupled. The first coupling part 127 may be formed in a protrusion shape such that the elastic support part 130 can be inserted. The elastic support part 130 may include a spring such as a coil spring which provides an elastic force, as described in the drawing.

A second coupling part 616 in which the elastic support part 130 is inserted may be provided at the first rail guide 61. The second coupling part 616 may be formed to protrude upward from one side of the first rail guide 61. The elastic support part 130 may be inserted onto the second coupling part 616, and thus the second coupling part 616 may support the elastic support part 130.

The elastic support part 130 may be separated from the first coupling part 127 or the second coupling part 616 by rotation of the idle gear 120. Therefore, the first coupling part 127 may not be disposed at a position vertical to the second coupling part 616, may be disposed at a position biased toward a rear side, and then may be coupled to the elastic support part 130 in a state in which the elastic support part 130 is bent (referring to FIG. 13). At this time, the elastic support part 130 may be bent while being compressed by a predetermined distance. Since the elastic support part 130 is coupled while being bent, the elastic support part 130 may be prevented from being separated from the first coupling part 127 or the second coupling part 616.

When the door 10 is drawn out of the storage compartment 4, the first pinion 51 is rotated to one side, and when the door 10 is inserted into the storage compartment 4, the first pinion 51 is rotated to the other side. At this time, when the first pinion 51 is rotated to one side while being in contact with the idle gear 120, the idle gear 120 is engaged with the first pinion 51. When the first pinion 51 is rotated to the other side while being in contact with the idle gear 120, the idle gear 120 is not engaged with the first pinion 51, and is rotated downward. Accordingly, the torsion of the door 10 may be prevented. This will be described in detail with reference to FIG. 6 or the like.

Meanwhile, when the idle gear 120 is rotated, a noise may be generated due to a collision between the idle gear 120 and the first rail guide 61. The refrigerator 1 may include a repulsive force generation part which reduces the noise. The repulsive force generation part applies forward a force to the idle gear 120, and thus reduces a shock due to the collision between the idle gear 120 and the first rail guide 61. Thus, the noise may be reduced.

The repulsive force generation part may include a first magnet 128 which is installed at a rear end of the idle gear 120, and a second magnet 617 which is installed at the first rail guide 61 and generates a repulsive force against the first magnet 128. The first magnet 128 and the second magnet 617 may be disposed to face each other.

The first magnet 128 and the second magnet 617 may be disposed so that the same poles face each other, and thus a repulsive force acts between the first magnet 128 and the second magnet 617. Also, since a distance between the first magnet 128 and the second magnet 617 is reduced as the idle gear 120 is moved backward, an intensity of the repulsive force acting between the first magnet 128 and the second magnet 617 may be increased.

Hereinafter, an operation of the first pinion 51 and the idle gear 120, when the door 10 is inserted, will be described.

Figure 6:
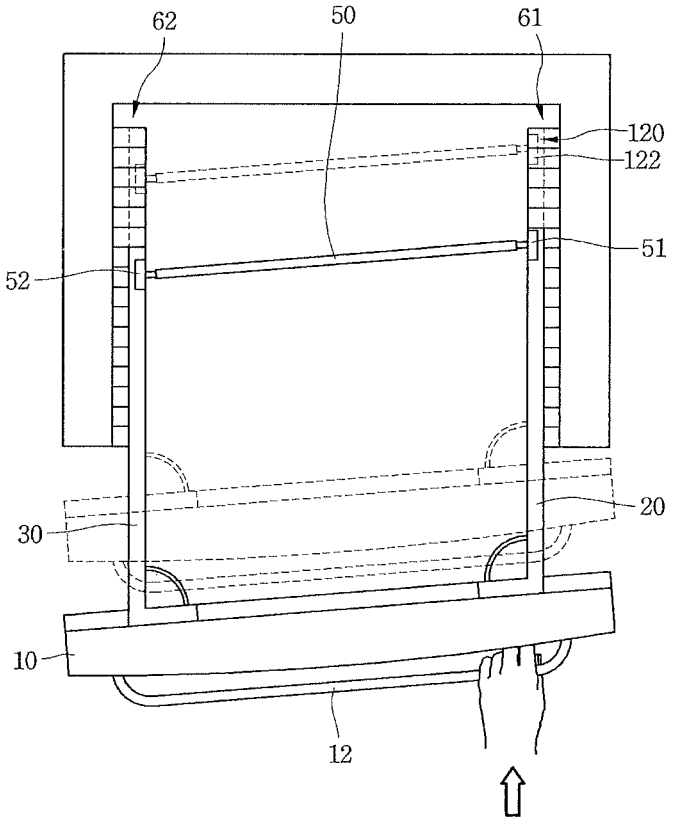
FIG. 6 is a view of an example door being inserted while being inclined to the right side.
Figure 7:
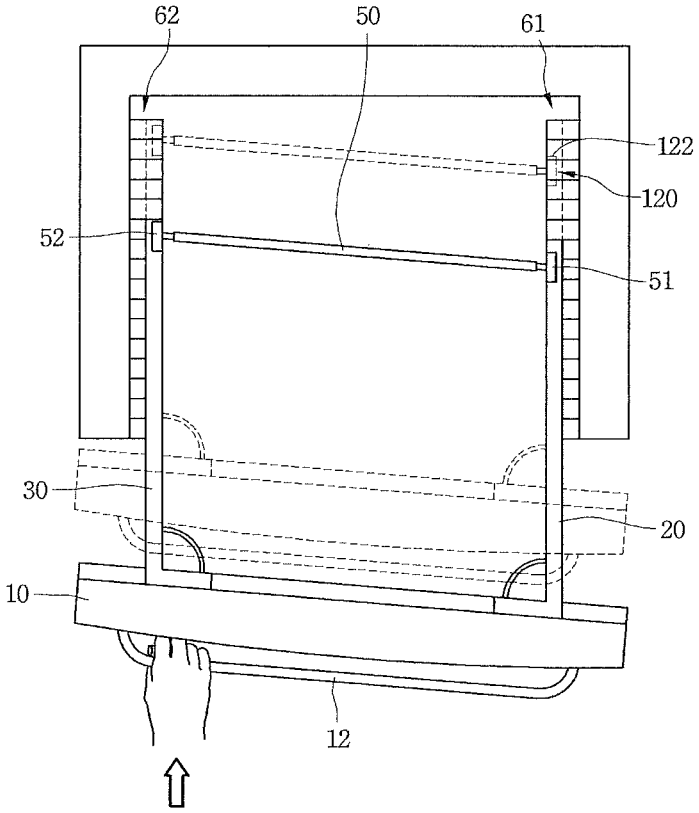
FIG. 7 is a view of an example door being inserted while being inclined to the left side.
Figure 8:
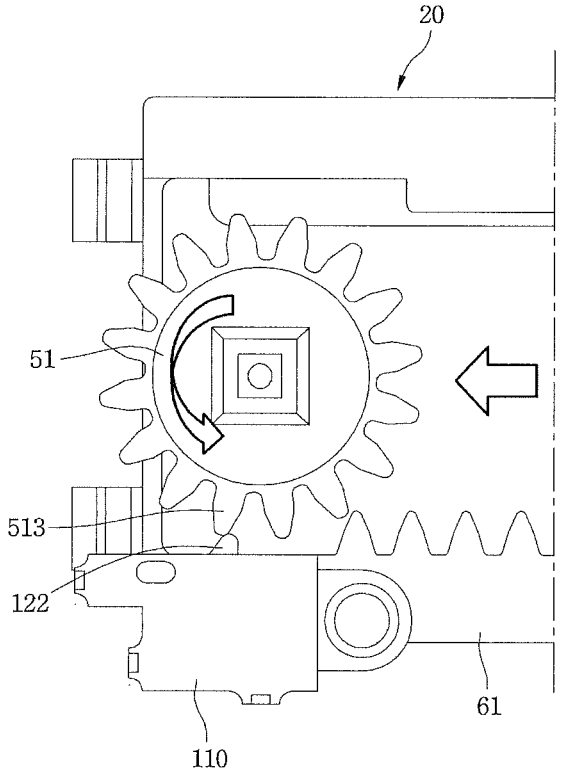
FIG. 8 is a view of an example pinion and an example torsion prevention part when a door is inserted.
Figure 9:
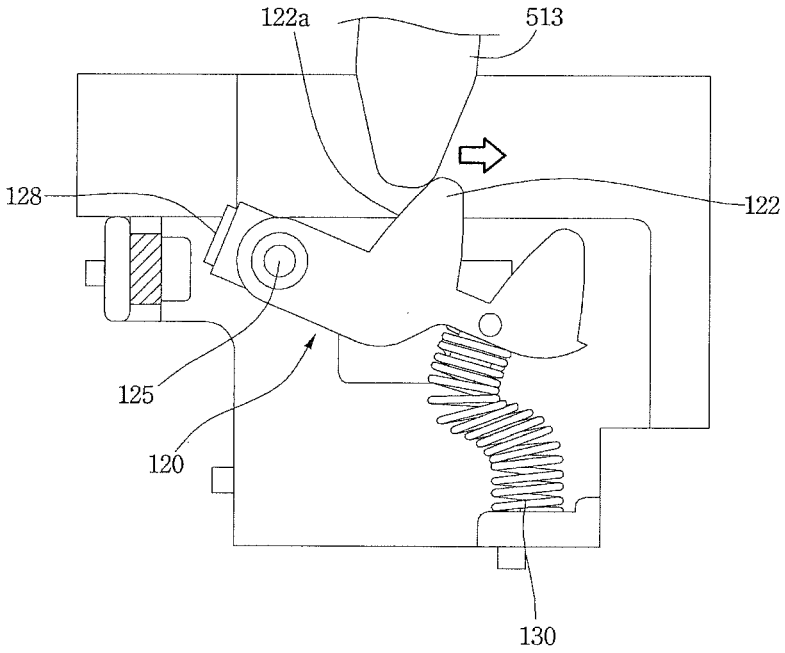
FIG. 9 is a view of an example torsion prevention part when a door is drawn out.

FIG. 6 illustrates an example door being inserted while being inclined to the right side. FIG. 7 illustrates an example door being inserted while being inclined to the left side. FIG. 8 illustrates an example pinion and an example torsion prevention part when the door is inserted. FIG. 9 illustrates an example torsion prevention part when a door is drawn out.

Referring to FIGS. 6 to 9, while the storage compartment 4 is opened, the user may insert the door 10 into the storage compartment 4. At this time, a force applied to one of a right side and a left side of the door 10 by the user may be relatively great, and thus, the door 10 may be moved in a state in which one side of the door 10 is further moved than the other side thereof by a predetermined distance. Accordingly, the torsion of the door 10 occurs.

Until before the first pinion 51 arrives at a position in which the gear part 122 is located, the door 10 is moved in a twisted state to the right or left side. This is because the first pinion 51 and the second pinion 52 are coupled with each other through the shaft 50 which may not be relatively rotated, and thus the first pinion 51 and the second pinion 52 are rotated equally.

As illustrated in FIG. 8, when the first pinion 51 reaches the gear part 122, a tooth 513 of the first pinion 51 presses the gear part 122, and thus the idle gear 120 is rotated about the hinge shafts 124 and 125.

In other words, the tooth 513 of the first pinion 51 presses a rear surface 122*a* of the gear part 122, and thus the idle gear 120 is rotated in a clockwise direction. Therefore, the first pinion 51 is not engaged with the idle gear 120. At this time, the elastic support part 130 is compressed while being bent backward, and the idle gear 120 is rotated along a trajectory of the side surface 615*c* of the guide groove 615. At this time, since the guide protrusion 126 is inserted into the guide groove 615, the idle gear 120 may be rotated within a range in which the guide protrusion 126 is guided by the guide groove 615.

The case in which the user applies a force to the right side of the door 10, and inserts the door 10 will be first described. At this time, the user applies a great force in a moment against a static friction force. Then, the door 10 is moved in a state in which the right side of the door 10 is further inserted than the left side thereof.

When the first pinion 51 reaches the gear part 122 in the state in which the right side of the door 10 is further inserted toward the storage compartment 4, the first pinion 51 is rotated in a stopped state, and the second pinion 52 is rotated while being moved. Therefore, while the right side of the door 10 is in the stopped state, the left side of the door 10 may be moved. Accordingly, the right side and the left side of the door 10 may be aligned with each other.

Then, the case in which the user applies the force to the left side of the door 10, and inserts the door 10 will be described. At this time, the door 10 is moved in a state in which the second pinion 52 is further moved further than the first pinion 51.

When the second pinion 52 is moved to an end of the second rail guide 62, the first pinion 51 reaches the gear part 122. When the second pinion 52 is moved to the end of the second rail guide 62, the second pinion 52 may not be rotated, and thus the first pinion 51 which is connected with the second pinion 52 through the shaft 50 is also stopped.

However, a guide member which is able to forcibly pull the first pinion 51 or the first movable rail 28 is provided at one end of the first pinion 51, and thus the first pinion 51 may be moved without being rotated. Therefore, the left side and the right side of the door 10 may be aligned with each other.

Hereinafter, an operation of the first pinion 51 and the idle gear 120, when the door is drawn out, will be described.

Figure 10:
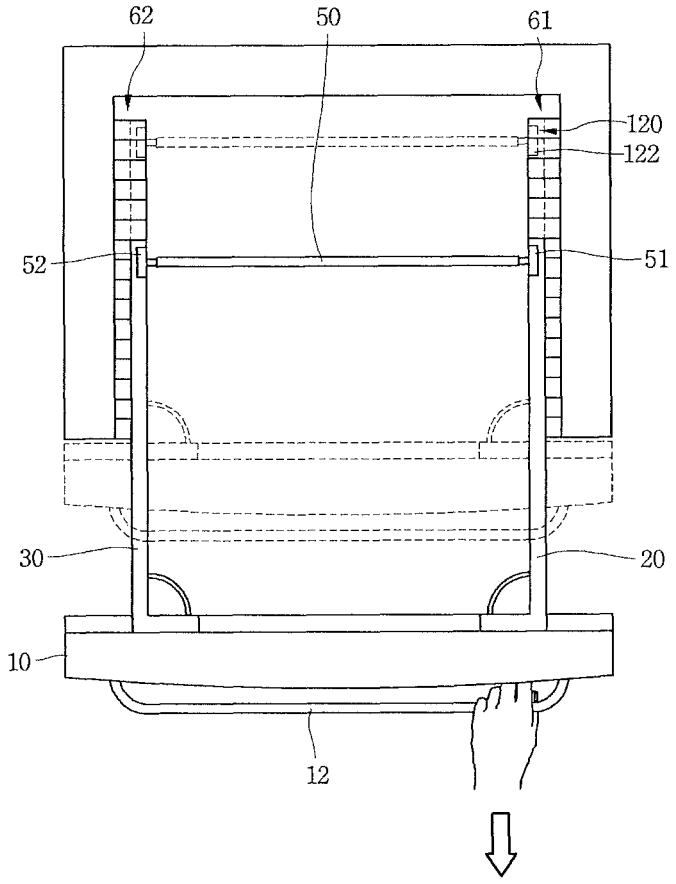
FIG. 10 is a view of an example door being drawn out.
Figure 11:
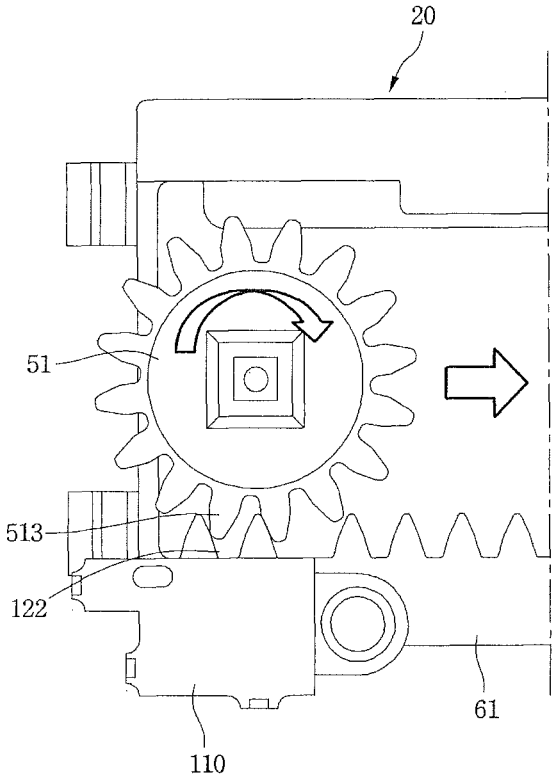
FIG. 11 is a view of an example pinion and an example torsion prevention part when a door is drawn out.
Figure 12:
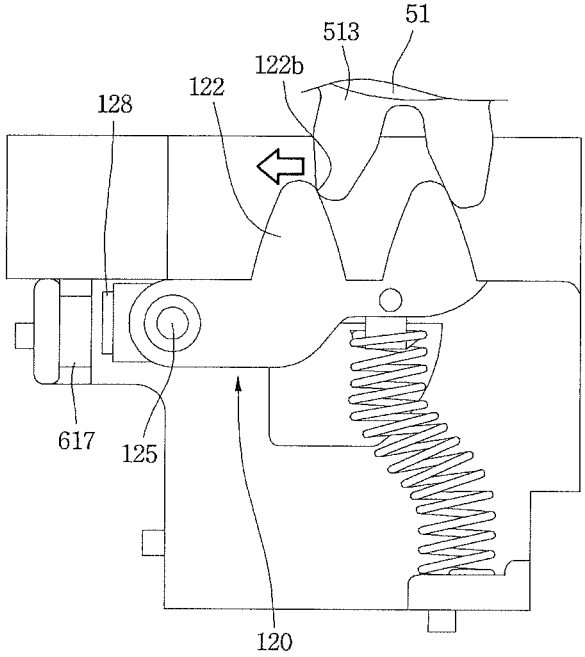
FIG. 12 is a view of an example torsion prevention part when a door is drawn out.
Figure 13:
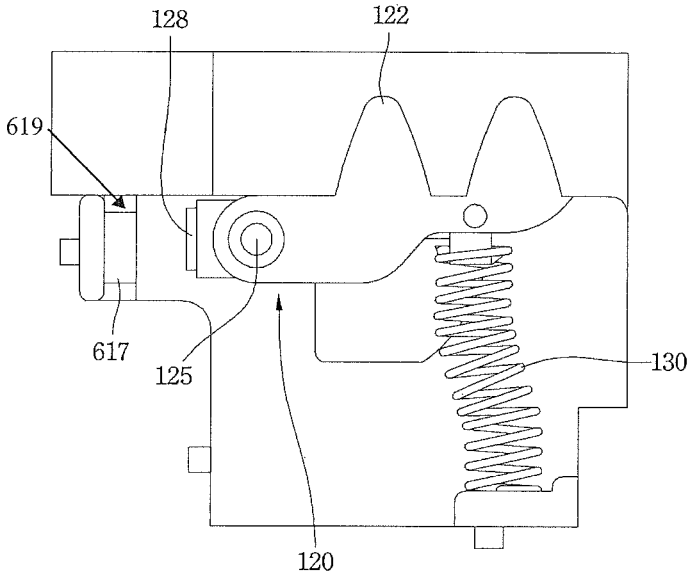
FIG. 13 is a view of an example idle gear being moved forward by an example repulsive force generation part.

FIG. 10 illustrates an example door being drawn out. FIG. 11 illustrates an example pinion and an example torsion prevention part when the door is drawn out. FIG. 12 illustrates an example torsion prevention part when the door is drawn out. FIG. 13 illustrates an example idle gear being moved forward by a repulsive force generation part 619.

When the user pulls and draws out the door 10 in a state in which the door 10 airtightly closes the storage compartment 4, the first pinion 51 presses a front surface 122*b* of the gear part 122. At this time, the first pinion 51 presses the front surface 122*b* of the gear part 122 toward an inside of the storage compartment 4, e.g., a rear side thereof.

Therefore, the first pinion 51 may be moved forward, while the tooth 513 of the first pinion 51 is engaged with the gear part 122. At this time, since the second pinion 52 is moved while being engaged with a tooth of the second rail guide 62, the door 10 may be drawn out, while the left side and the right side of the door 10 are aligned with each other.

Meanwhile, since the idle gear 120 may be movable by the hinge shafts 124 and 125, the idle gear 120 may be moved forward and backward to be engaged with the tooth 513 of the first pinion 51. When the tooth 513 of the first pinion 51 presses the gear part 122, and thus the idle gear 120 is pressed backward, the idle gear 120 receives a force toward the front side by the first and second magnets 128 and 617 of the repulsive force generation part 619. Therefore, the noise generated when the hinge shaft 124 collides with the guide part 613 may be reduced.

Hereinafter, the case in which, instead of the magnets 128 and 617, an elastic member is installed at the repulsive force generation part 619 will be described as another example.

Figure 14:
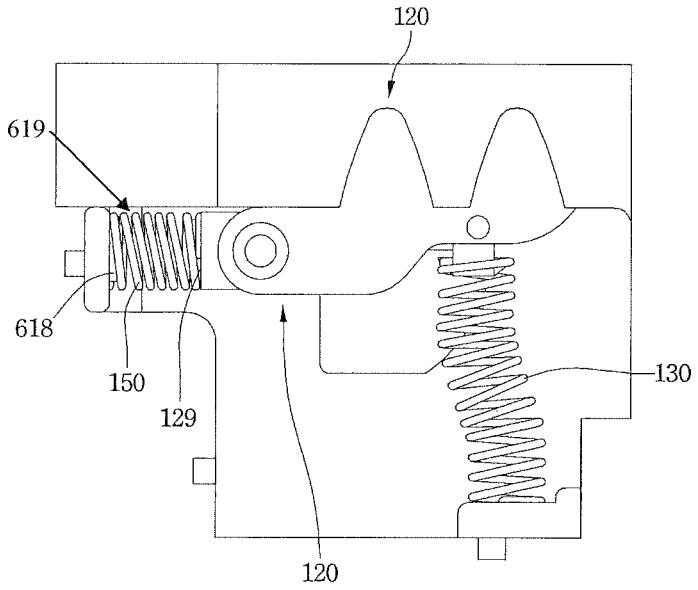
FIG. 14 is a view of an example noise prevention part.

FIG. 14 illustrates an example noise prevention part.

Referring to FIG. 14, the refrigerator 1 may include an elastic member 150 which connects the idle gear 120 with the first rail guide 61. The elastic member 150 may include a spring such as a coil spring which provides an elastic force, as illustrated in the drawing.

One side of the elastic member 150 may be installed at the rear end of the idle gear 120, and the other side thereof may be installed at the first rail guide 61. The idle gear 120 may be pressed toward the front side by the elastic member 150.

One side of the elastic member 150 may be inserted into and supported by a first support protrusion 129 formed at the rear end of the idle gear 120. Also, the other side of the elastic member 150 may be inserted into and supported by a second support protrusion 618 which is formed at the first rail guide 61 and disposed to face the first support protrusion 129.

The elastic member 150 may perform a function of applying a force to the idle gear 120 toward the front side, like the repulsive force generation part 619 using the magnets 128 and 617. However, when the elastic member 150 is used, a vibration which may occur when the elastic member 150 is compressed may be transmitted to the idle gear 120, and thus the noise may be generated by the collision between the idle gear 120 and the first rail guide 61. Therefore, the case in which the magnets are used as the repulsive force generation part 619 may be further effective to prevent the noise due to the collision between the idle gear 120 and the first rail guide 61, compared with the case in which the elastic member like the spring is used.

As described above, the refrigerator 1 can reduce the nose due to the collision between the idle gear 120 and the first rail guide 61 by installing the repulsive force generation part 619 at the torsion prevention part 100. Accordingly, the refrigerator 1 can prevent the torsion of the door 10 and also can reduce the noise so as to enhance a customer satisfaction rate.

What is claimed is:

1. An refrigerator comprising:

a body that defines a storage space;

a door that is configured to selectively open and close the storage space;

a first rail guide that is connected to a first side wall of the storage space;

a second rail guide that is connected to a second side wall of the storage space;

a first rail assembly that is configured to connect the door with the first rail guide;

a second rail assembly that is configured to connect the door with the second rail guide;

a shaft that is configured to connect the first rail assembly with the second rail assembly;

a first pinion that is located at a first end of the shaft and that is configured to engage the first rail guide based on the door being pushed in or pulled out;

a second pinion that is located at a second end of the shaft and that is configured to engage the second rail guide based on the door being pushed in or pulled out; and a torsion reduction part that is located at one of the first rail guide or the second rail guide, that is configured to reduce torsion of the door, and that comprises:

an idle gear (i) that includes a hinge shaft that is rotatably inserted into the one of the first rail guide or the second rail guide and (ii) that is configured to selectively engage one of the first pinion or the second pinion;

an elastic support part that is connected to a lower end of the idle gear and that is connected to the one of the first rail guide or the second rail guide; and a repulsive force generation part that is located at the idle gear and the one of the first rail guide or the second rail guide and that is configured to generate a force that pushes the idle gear forward, wherein the hinge shaft is configured to move forward and backward based on being inserted into a guide part that is located at the one of the first rail guide or the second rail guide.

2. The refrigerator according to claim 1, wherein the guide part is a hole or a groove that extends forward and backward a predetermined length.

3. The refrigerator according to claim 1, wherein the repulsive force generation part comprises:

a first magnet that is installed at the idle gear; and a second magnet that is installed at the one of the first rail guide or the second rail guide and that is configured to repel the first magnet.

4. The refrigerator according to claim 1, wherein the elastic support part is a spring that is oriented vertically, that is coupled to a first coupling part of the idle gear, and that is coupled to a second coupling part of the one of the first rail guide or the second rail guide, the elastic support part being curved based on the first coupling part being moved to a rear of the second coupling part.

5. The refrigerator according to claim 1, wherein:

the elastic support part is configured to compress and a front end of the idle gear is configured to rotate downward based on one of the first pinion or the second pinion rotating in a first direction, and the elastic support part is configured to support the front end of the idle gear and the idle gear is configured to move backward based on the one of the first pinion or the second pinion rotating in a second direction.

6. The refrigerator according to claim 5, wherein the first direction is opposite the second direction.

7. The refrigerator according to claim 5, wherein based on the idle gear moving backward, a force that is applied to the idle gear by the repulsive force generation part is gradually increased.

8. The refrigerator according to claim 1, wherein a guide protrusion is located at the idle gear, the guide protrusion being configured to guide rotation of the idle gear.

9. The refrigerator according to claim 1, wherein the repulsive force generation part comprises an elastic member that connects the idle gear with the one of the first rail guide or the second rail guide.

10. The refrigerator according to claim 1, wherein:

the idle gear includes a gear part that includes idle gear teeth that are spaced apart by a first distance, and the first rail guide and the second rail guide include rail guide teeth that are spaced apart by the first distance.

11. The refrigerator according to claim 10, wherein an idle gear tooth and a rail guide tooth of the one of the first rail guide or the second rail guide are spaced apart by a second distance that is greater than the first distance.

12. The refrigerator according to claim 10, wherein the gear part includes two idle gear teeth.

13. The refrigerator according to claim 1, wherein a rack is connected to a lower side of the first rail guide and is connected to a lower side of the second rail guide.

14. The refrigerator according to claim 13, wherein the first pinion is configured to move the rack based on the door being pushed in or pulled out.

15. The refrigerator according to claim 13, wherein the second pinion is configured to move the rack based on the door being pushed in or pulled out.

16. The refrigerator according to claim 1, further comprising a noise reduction part that connects one of the first rail guide or the second rail guide to an end of the idle gear that is opposite the lower end that is connected to the elastic support part.

17. The refrigerator according to claim 16, wherein the noise reduction part is a spring.

* * * * *